US008850766B1

(12) United States Patent
Malinajdovski

(10) Patent No.: US 8,850,766 B1
(45) Date of Patent: Oct. 7, 2014

(54) DECORATIVE MOLDING WITH MULTIPLE RELIEF INSERT

(71) Applicant: Zlate Malinajdovski, Elmwood Park, NJ (US)

(72) Inventor: Zlate Malinajdovski, Elmwood Park, NJ (US)

( * ) Notice: Subject to any disclaimer, the term of this patent is extended or adjusted under 35 U.S.C. 154(b) by 0 days.

(21) Appl. No.: 13/958,031

(22) Filed: Aug. 2, 2013

Related U.S. Application Data

(60) Provisional application No. 61/683,884, filed on Aug. 16, 2012.

(51) Int. Cl.
*E04C 1/00* (2006.01)
*E04F 19/02* (2006.01)
*E04F 19/04* (2006.01)

(52) U.S. Cl.
CPC ..... *E04F 19/02* (2013.01); *E04F 19/0481* (2013.01)
USPC ..... 52/312; 52/290; 52/288.1; 52/716.1; 52/287.1; 52/716.8

(58) Field of Classification Search
USPC ..... 52/312, 288.1, 290, 716.1, 287.1, 52/716.3, 717.04; 174/504
See application file for complete search history.

(56) References Cited

U.S. PATENT DOCUMENTS

| | | | | |
|---|---|---|---|---|
| 4,000,597 | A * | 1/1977 | Burton | 52/716.1 |
| 4,066,285 | A * | 1/1978 | Hall et al. | 293/120 |
| 5,463,835 | A * | 11/1995 | Wood | 52/288.1 |
| 6,205,741 | B1 * | 3/2001 | Couto et al. | 52/745.19 |
| 6,474,038 | B2 * | 11/2002 | Nien et al. | 52/717.01 |
| 2002/0144833 | A1 * | 10/2002 | Russell et al. | 174/48 |
| 2003/0115813 | A1 * | 6/2003 | Wong Hahn | 52/288.1 |
| 2005/0257485 | A1 * | 11/2005 | Hahn | 52/716.1 |
| 2007/0199275 | A1 * | 8/2007 | Kurz | 52/716.1 |

* cited by examiner

*Primary Examiner* — Robert Canfield
*Assistant Examiner* — Babajide Demuren
(74) *Attorney, Agent, or Firm* — Harpman & Harpman

(57) ABSTRACT

A decorative molding assembly for a variety of surface applications providing a complex molding feature with a machine made single component set composite configured insert. A channel base molding receives a unique configured U-shaped insert forming linear spaced and aligned viewing openings for an underlying contrasting base material achieving a hand crafted detailed look with a single overlying molding tunnel insert combination.

5 Claims, 6 Drawing Sheets

DECORATIVE MOLDING WITH MULTIPLE RELIEF INSERT

This application claims the benefit of U.S. Provisional Patent Application No. 61/683,884, filed Aug. 16, 2012.

BACKGROUND OF THE INVENTION

1. Technical Field

The present invention is directed to manufacturing of decorative trim such as cornices that provide for detailed woodworking features and architectural structures.

2. Description of Prior Art

Prior art devices of this type have been developed to enable different trim and finish molding venues, see for example U.S. Pat. Nos. 3,956,861, 4,706,431, 5,444,956 and U.S. Pat. No. 7,168,474.

U.S. Pat. No. 3,956,861 discloses a trim arrangement for interior partitions wherein a partition panel has a channel for receiving fasteners and a cover concealment strip which is frictionally inserted therein.

U.S. Pat. No. 4,706,431 claims a recessed decorative molding for wood paneling having a groove for receiving a decorative strip insert for use in a wood door panel.

U.S. Pat. No. 5,444,956 is directed to a trim molding with removable insert. A trim molding has an elongated channel into which a backing is positioned with an overlying abutting cut-away insert so as to expose a portion of the locking insert therethrough.

U.S. Pat. No. 7,168,474 is directed towards a decorative device comprised of modular interchangeable components which has a cornice for crowning an architectural structure with a decorative center piece in the cornice which is applied therein to provide interest.

SUMMARY OF THE INVENTION

A multi-part decorative trim molding assembly to simulate a hand carved decorative trim piece with relief surfaces. A base molding has a contrasting material upstanding insert in a recessed channel. A U-shaped "tunnel" molding trim having intermediate portions cut-away is inverted and straddles the upstanding insert to provide a true recessed independent composite insert configuration wherein the tunnel molding trim is spaced in relation to the upstanding contrasting material insert within the base molding.

DETAILED DESCRIPTION OF THE INVENTION

Figure 1:
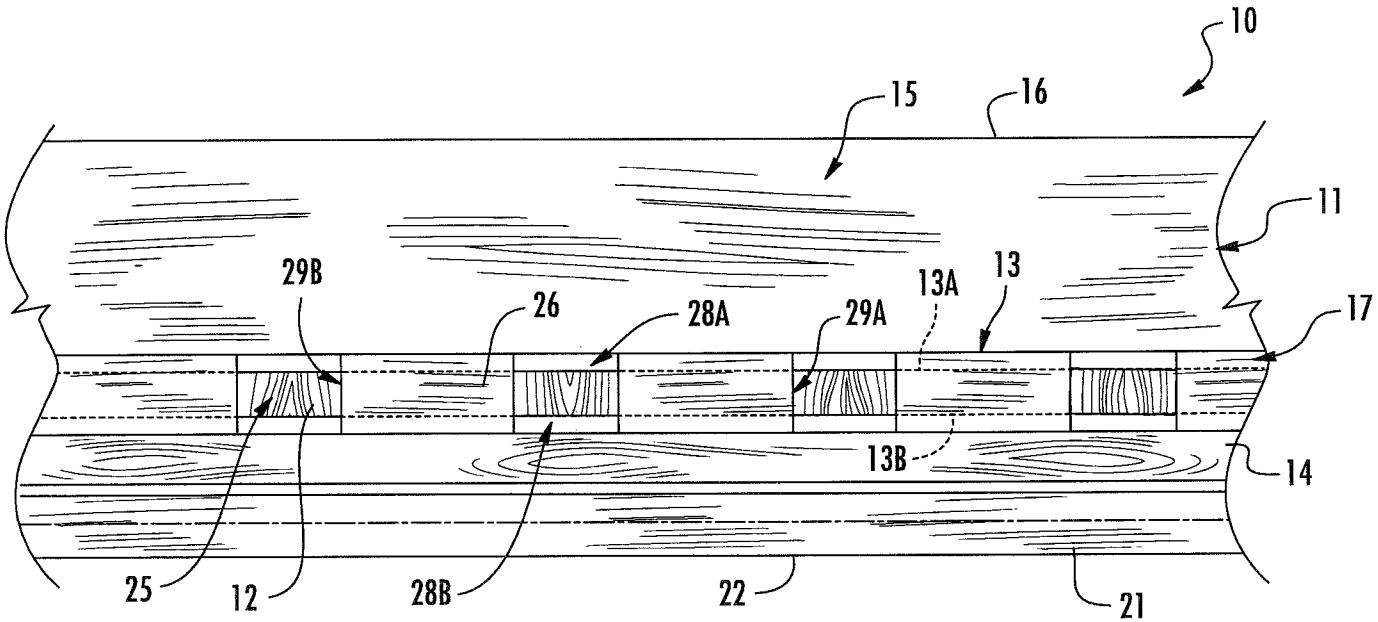
FIG. 1 is a top plan view of an assembled trim molding of the invention illustrating the multiple insert openings therewithin.
Figure 2:
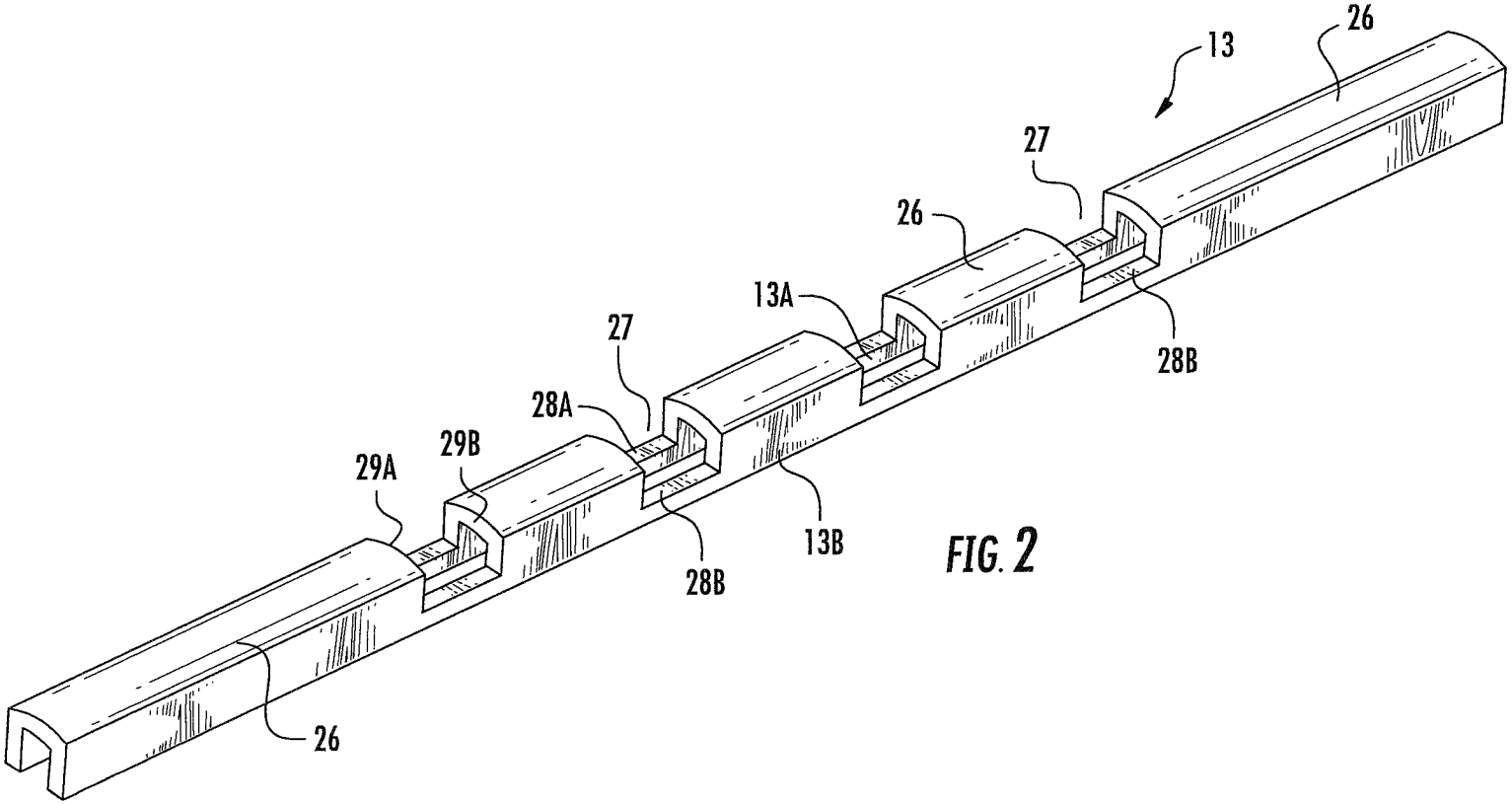
FIG. 2 is a perspective view of a portion of the assembled molding configuration.
Figure 3:
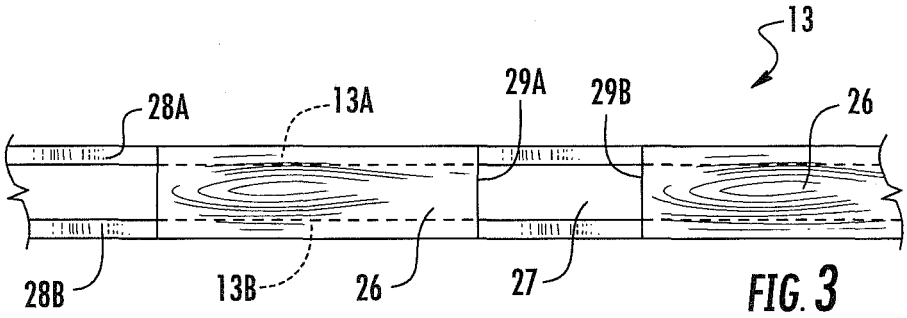
FIG. 3 is a top plan view of a portion of the insert trim.
Figure 4:
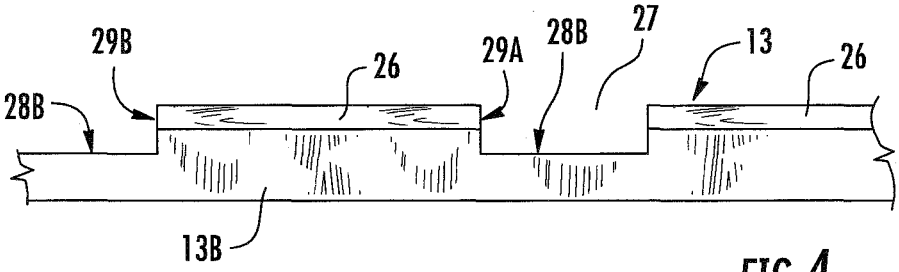
FIG. 4 is a side elevational view thereof.
Figure 6:
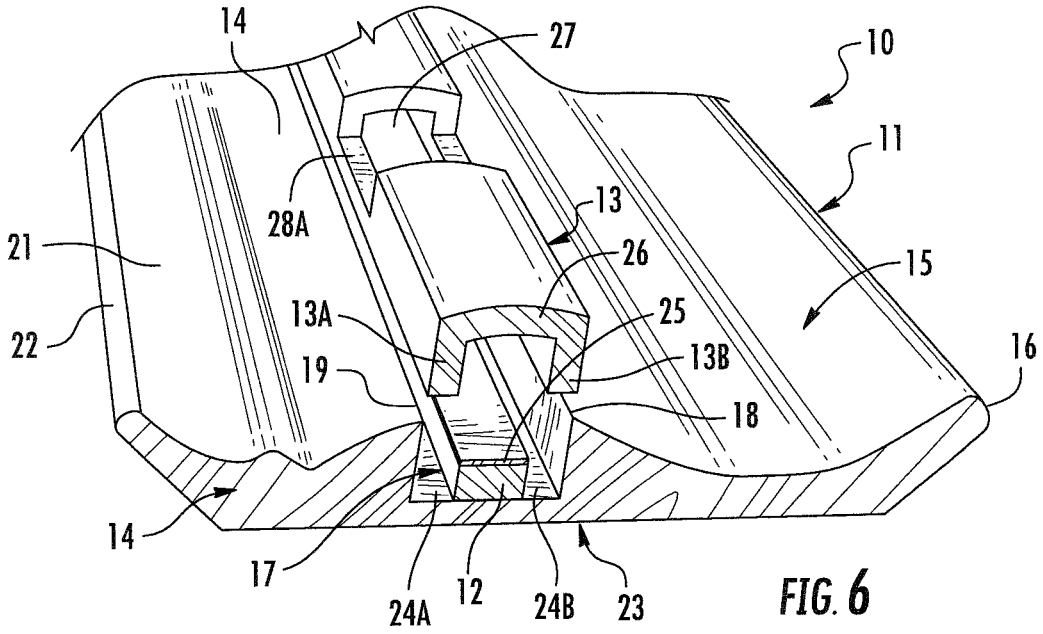
FIG. 6 is a partial exploded perspective view of the trim molding assembly of the invention.

Referring to FIGS. 1 and 6 of the drawings, the trim molding assembly 10 of the invention can be seen having a base mounting molding 11, a decorative insert strip 12 and a U-shaped apertured viewing insert 13. The base receiving mounting molding 11 comprises an integral elongated strip of milled material 14, in this example preferably wood. The top surface being contoured with a first contoured surface portion 15 extending inwardly from an upstanding perimeter edge 16. A receiving channel 17 extends longitudinally within defining the inward terminal edge at 18 of the concave surface portion 15 as best seen in FIG. 6 of the drawings.

An opposite spaced parallel edge at 19 of the channel 17 defines the transverse dimension thereof. An angled top surface portion 14 extends from the terminal edge 19 in a convex surface contour at 20 which transitions into a curvilinear concave surface portion 21 with a rounded over upstanding parallel base perimeter edge portion 22.

A flat bottom or back surface 23 interconnects said respective upstanding portions 22 and 16 completing the base receiving mounting molding 11.

The decorative channel insert strip 12 can be seen best in FIGS. 1 and 6 of the drawings comprises in this example an elongated cross-sectionally rectangular material having a transverse dimension substantially less than that of the corresponding channel dimension 17 and is positioned midway therein in spaced side to side relation forming corresponding receiving channels 24A and 24B.

The decorative insert molding strip 12 may be of a different material to that of the base 11, such as a varied wood variety or a contrasting "stain" color.

Alternately, a veneer overlay 25 can be pre-applied to the exposed upper surface 12A of the strip 12 by conventional adhesion bonding techniques well know within the art. The veneer overlay 25 may be of any material including wood veneers or other contrasting non-wood materials.

Figure 5:
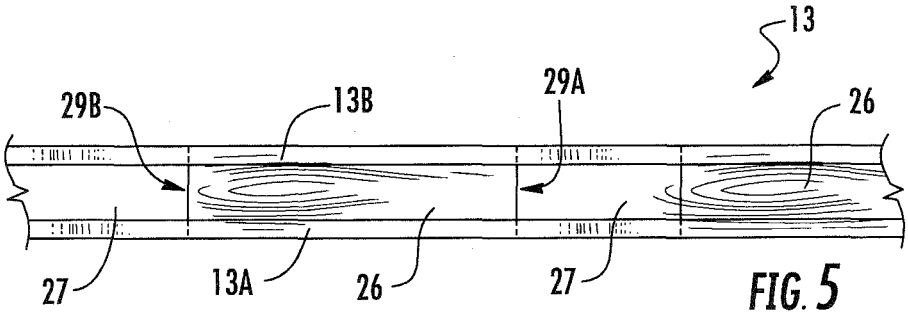
FIG. 5 is a bottom plan view thereof.

The key structural element to the trim molding assembly 10 of the invention is the inverted for installation U-shaped insert strip 13, best seen in FIGS. 5 and 6 of the drawings. The insert strip 13 is, as noted, of a generally inverted U-shaped having oppositely disposed leg portions 13A and 13B with an integral interconnecting contoured top 26 therebetween. A plurality of longitudinally spaced view port openings 27 are formed therein extending inwardly from the contoured top 26 to midway in the respective leg portions 13A and 13B. The openings 27 define parallel spaced exposed leg edge surfaces 28A and 28B with oppositely disposed spaced contoured top exposed edge surfaces 29A and 29B.

The longitudinal length of each of the respective view port openings 27 as illustrated in FIGS. 2, 3, 4 and 5 of the drawings is proportional to the intermediate remaining top 26 and leg areas 30 therebetween indicated generally and depending on the design venue of the application chosen which in this example is approximately one-half the length thereof.

The transverse width of the insert viewing strip 13 is also variable depending on the design requirements of the use application.

Referring now to FIG. 6 of the drawings, the assembly sequence of the trim molding assembly 10 can be seen wherein the base receiving molding 11 having the recessed channel 17 therein is illustrated with the initial placement of the decorative strip 12 within. The viewing insert 13 is then positioned thereover with the legs 13A and 13B registerable with the corresponding defined receiving areas 24A and 24B in the channel 17 as the hereinbefore defined by the insert position strip 12.

As noted, the decorative strip 12 may have a veneer overlay 25 as illustrated in the assembled molding in FIG. 1 of the drawings and in FIG. 6 of the drawings.

Figure 7:
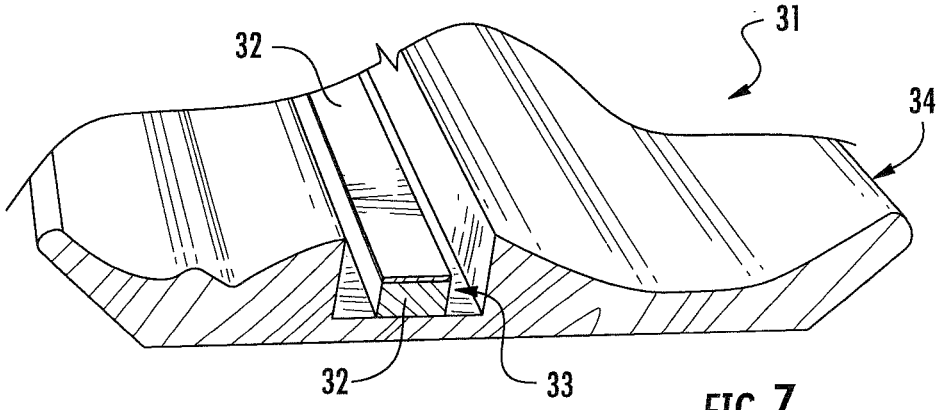
FIG. 7 is a partial perspective view of a base trim of an alternate form of the invention.

Referring now to FIG. 7 of the drawings, an alternate form of the invention 31 can be seen wherein a decorative strip 32 is formed integral within a channel 33 in a base molding 34 which may be required in some venues.

Figure 8:
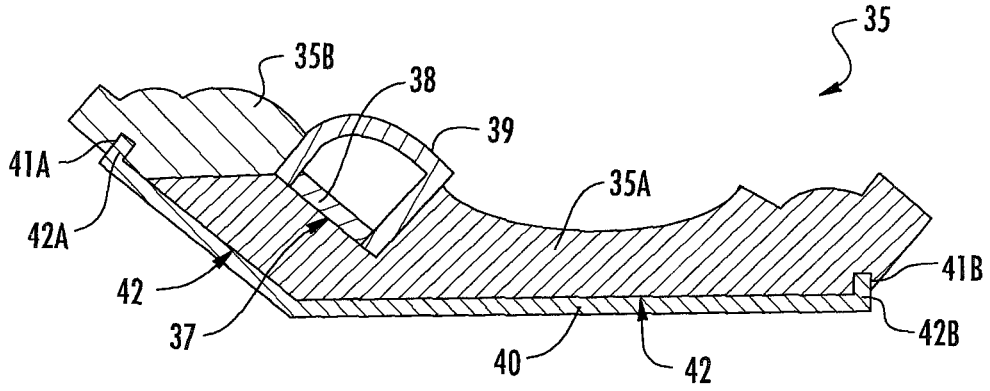
FIG. 8 is a cross-sectional view of an alternate trim molding assembly of the invention.
Figure 9:
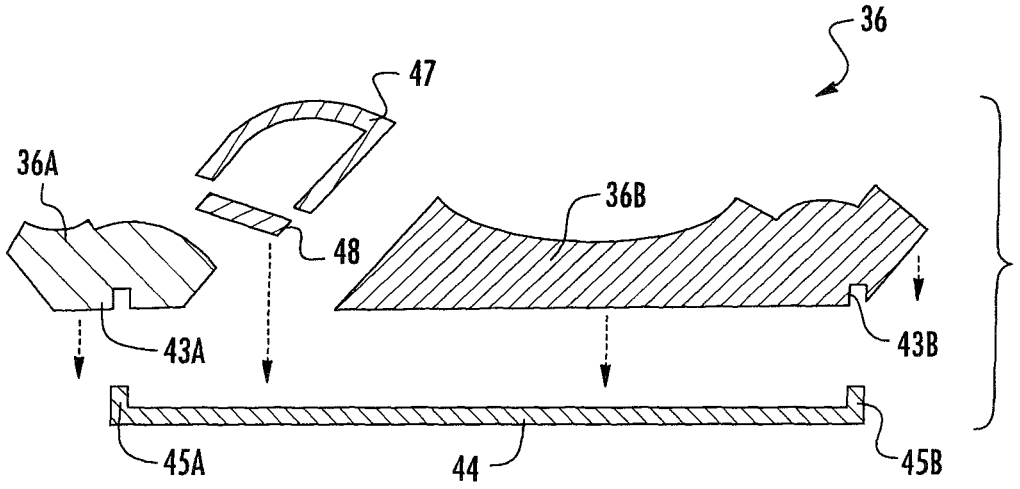
FIG. 9 is an exploded cross-sectional view of a second alternate trim molding assembly of the invention.

Referring now to FIGS. 8 and 9 of the drawings, multiple alternate trim molding forms can be seen at 35 and 36 wherein a two-part base molding 35A and 35B in FIGS. 8 and 36A and 36B in FIG. 9 of the drawings.

The base molding 35A has a receiving area 37 formed therein which allows for the insertion of a decorative strip 38, such as contrasting material or veneer with a U-shaped apertured viewing insert 39 positioned thereover similar to the strip 13 as set forth and described in the primary form of the invention.

In this example, an additional base molding portion 35B is attached to one end of the base molding 35A by the utilization of an elongated backing strip 40. Both the base molding 35A and base molding portion 35B have attachment channels 41A and 41B respectively in their non-viewing reverse surfaces 42 and 42. The backing strip 40 has oppositely disposed upstanding flanges 42A and 42B will, upon assembly, be registerably engaged within the respective attachment channels 41A and 41B securing the multiple part molding assembly together.

A similar assembly can be seen in FIG. 9 of the drawings wherein the base molding 36 has the two-piece assembly 36A and 36B with corresponding attachment channels 43A and 43B therein respectively. As described previously, a backing strip 44 having oppositely disposed upstanding engagement flanges 45A and 45B is registerable within corresponding aligned elongated receiving channels 46A and 46B within the non-viewable sides of the respective two-part molding base as hereinbefore described in spaced aligned relation to one another.

In this example, an independent U-shaped aperture viewing insert 47 and a decorative insert 48 are held between the respective interengaged molding bases 36A and 36B completing the decorative multi-part molding 36 form of the invention.

Figure 10:
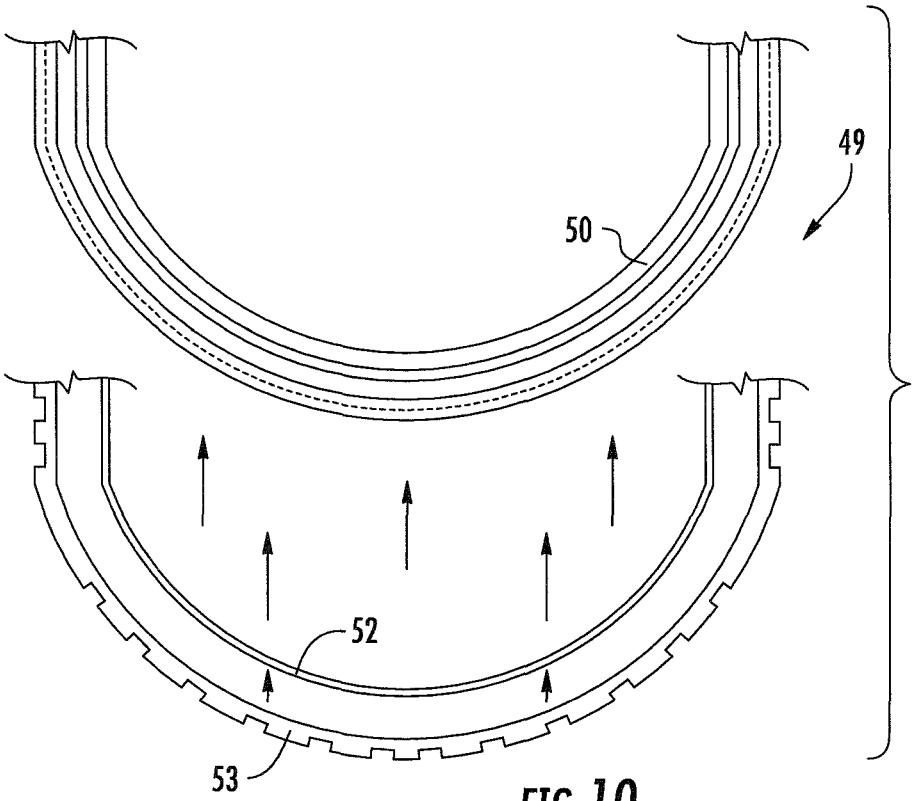
FIG. 10 is an exploded top plan view of a third alternate form of the invention.
Figure 11:
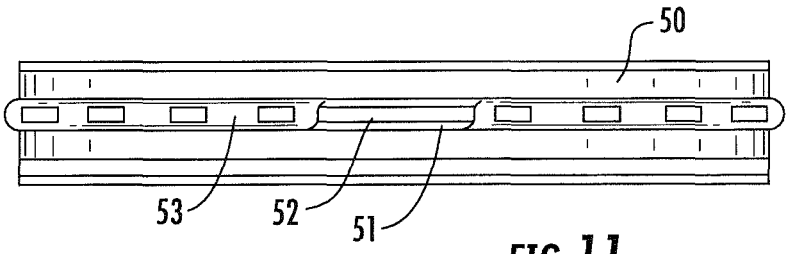
FIG. 11 is a front elevational view of the third alternate assembly thereof.

Referring now to FIGS. 10 and 11 of the drawings, a curved trim molding assembly 49 can be seen where like in the primary trim molding assembly 10, an elongated contoured base portion 50 in this configuration curved, has a receiving channel 51 formed therein. A decorative insert strip 52 is positioned within the channel with a correspondingly curved U-shaped apertured viewing insert 53 is correspondingly positioned therewithin to achieve the complete curved trim molding assembly 49 having the same unique visualization of the hereinbefore primary and secondary and third forms of the invention, previously described.

It will thus be seen that a new and novel decorative molding with multiple relief insert has been illustrated and described and it will be apparent to those skilled in the art that various changes and modifications may be made therein without departing from the spirit of the invention. Therefore I claim:

The invention claimed is:

1. An elongated decorative trim molding assembly comprising, an elongated base molding, a receiving channel within said base molding, a decorative insert strip within said channel, an elongated inverted U-shaped viewing insert selectively positioned within said channel overlying and in spaced relation to said decorative insert strip, a plurality of longitudinally spaced openings formed in said viewing insert aligned with said decorative insert.

2. The elongated decorative trim molding assembly set forth in claim 1 wherein said base molding is contoured.

3. The elongated decorative trim molding assembly set forth in claim 1 wherein said decorative insert strip is transversely centered within said receiving channel defining oppositely disposed viewing insert receiving channels.

4. The elongated decorative trim molding insert set forth in claim 1 wherein said U-shaped viewing insert has a plurality of longitudinally spaced openings having oppositely disposed co-planar leg edge surfaces.

5. The elongated decorative trip molding assembly set forth in claim 1 wherein said U-shaped viewing insert has parallel spaced leg portions and an interconnecting contoured top therebetween.

* * * * *